US007168259B2

(12) United States Patent
Yoon

(10) Patent No.: US 7,168,259 B2
(45) Date of Patent: Jan. 30, 2007

(54) AIR CONDITIONER

(75) Inventor: Kyung Ho Yoon, Suwon (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 213 days.

(21) Appl. No.: 10/813,614

(22) Filed: Mar. 31, 2004

(65) Prior Publication Data

US 2005/0039478 A1 Feb. 24, 2005

(30) Foreign Application Priority Data

Aug. 19, 2003 (KR) ..... 10-2003-0057229

(51) Int. Cl.
*F25D 23/12* (2006.01)

(52) U.S. Cl. ..... 62/262

(58) Field of Classification Search ..... 62/262, 62/275, 298

See application file for complete search history.

(56) References Cited

U.S. PATENT DOCUMENTS 5,687,583 A * 11/1997 Tunekawa et al. ..... 62/404
6,182,460 B1 * 2/2001 Hernandez et al. ..... 62/262
6,412,298 B2 * 7/2002 Kang et al. ..... 62/262

FOREIGN PATENT DOCUMENTS

KR 2000-55580 9/2000

* cited by examiner

*Primary Examiner*—Melvin Jones
(74) *Attorney, Agent, or Firm*—Staas & Halsey LLP

(57) ABSTRACT

An air conditioner including a cabinet, a partition plate provided in the cabinet to partition an internal space of the cabinet, and an air inlet port and an air outlet port provided on the cabinet to draw and discharge indoor air into and from the cabinet, respectively. The air conditioner further has an evaporator placed adjacent to the air inlet port, a fan to draw the indoor air into the cabinet through the air inlet port, an air guide duct to guide the indoor, and an air discharging duct supported on the partition plate adjacent to the air guide duct. Because the air discharging duct is supported on the partition plate, the air conditioner prevents the air discharging duct from being displaced from a desired position regardless of a vibration or impact applied to the air discharging duct. Thus, the assembling process of the air conditioner is simplified.

17 Claims, 4 Drawing Sheets

AIR CONDITIONER

CROSS-REFERENCE TO RELATED APPLICATIONS

This application claims the benefit of Korean Patent Application No. 2003-57229, filed Aug. 19, 2003 in the Korean Intellectual Property Office, the disclosure of which is incorporated herein by reference.

BACKGROUND OF THE INVENTION

1. Field of the Invention

The present invention relates, in general, to air conditioners, and more particularly, to an air conditioner with a simplified assembling process.

2. Description of the Related Art

Generally, air conditioners are apparatuses utilizing a principle of a refrigerating circuit to cool indoor air by discharging cooled air into a room. In the related art, there is an air conditioner of a single body type, in which a part of a cabinet that defines an appearance of the air conditioner is placed indoors, and a remaining part of the cabinet is placed outdoors.

In the conventional air conditioner of the single body type, an indoor air inlet port and an indoor air outlet port are provided on the indoor part of the cabinet, which is placed indoors, to draw and discharge the indoor air into and from the cabinet, respectively. The conventional air conditioner of the single body type further includes an outdoor air inlet port and an outdoor air outlet port which are respectively provided on the outdoor part of the cabinet, which is placed outdoors, to draw and discharge outdoor air into and from the cabinet.

The cabinet has a partition plate therein to partition an internal space of the cabinet into an indoor space part that is defined in the indoor part of the cabinet, and an outdoor space part that is defined in the outdoor part of the cabinet.

The indoor space part of the cabinet has an evaporator and an evaporator fan to execute a heat transfer between the indoor air and a refrigerant, and to circulate the indoor air, respectively. The outdoor space part of the cabinet has a condenser and a condenser fan to execute a heat transfer between the outdoor air and the refrigerant, and to circulate the outdoor air, respectively. The outdoor space part of the cabinet further includes a motor to operate the evaporator and the evaporator fan, and a compressor to compress the refrigerant to provide a high-temperature, high-pressure refrigerant.

Furthermore, the indoor space part of the cabinet includes an air guide duct to upwardly guide the indoor air that is drawn into the cabinet through the indoor air inlet port, which is provided on a front wall of the cabinet. The indoor space part of the cabinet further includes an air discharging duct to guide the indoor air to the air outlet port, positioned on the front wall of the cabinet, after the indoor air is guided upward by the air guide duct.

In the conventional air conditioner of the single body type, the air discharging duct is made of an insulating material, such as styrofoam, etc., to reduce an amount of condensation that forms on an upper casing that defines an upper wall of the cabinet. The condensation may be caused by a heat transfer between the cooled indoor air passing through the air discharging duct, and the upper casing of the cabinet.

But the insulating material, such as the styrofoam, etc., is not very strong, and when mounting the air discharging duct made of the insulating material to a predetermined position in the cabinet using locking members, such as locking screws, the air discharging duct may be easily damaged or broken by a fastening force of the screws. Accordingly, in the conventional air conditioners of the single body type, the air discharging duct is typically arranged at the predetermined position in the cabinet without using the locking members, and is indirectly supported at the predetermined position by other parts that are installed in the cabinet. When the air discharging duct is arranged in the cabinet without using the locking members, as desired above, the discharging duct may be displaced by a vibration or an impact applied to the air discharging duct during an assembling process of the air conditioner.

Accordingly, the conventional air conditioners of the single body type are problematic in that assembling workers are forced to carefully assemble the parts of the air conditioner into a single structure while checking the position of the air discharging duct in the cabinet, and thus, the assembling process of the conventional air conditioner is difficult and complex.

SUMMARY OF THE INVENTION

Accordingly, it is an aspect of the present invention to provide an air conditioner in which an assembling process of the air conditioner is simplified by preventing an air discharging duct in a cabinet from being displaced from a desired position in a cabinet.

Additional aspects and/or advantages of the invention will be set forth in part in the description which follows and, in part, will be obvious from the description, or may be learned by practice of the invention.

The above and/or other aspects are achieved by providing an air conditioner, including a cabinet to define an appearance of the air conditioner. The cabinet is installed such that a part of the cabinet is placed indoors, and a remaining part of the cabinet is placed outdoors. The air conditioner further includes: a partition plate provided in the cabinet to partition an internal space of the cabinet into an indoor space part to circulate indoor air, and an outdoor space part to circulate outdoor air; an air inlet port and an air outlet port provided on the part of the cabinet that is placed indoors, to draw and discharge the indoor air into and from the cabinet, respectively; an evaporator disposed in the cabinet adjacent to the air inlet port; a fan to draw the indoor air into the cabinet through the air inlet port such that the indoor air passes through the evaporator to be cooled, prior to being discharged to an outside of the cabinet through the air outlet port; an air guide duct to guide the indoor air which is drawn into the cabinet, the fan being disposed in the air guide duct; and an air discharging duct, engaging the partition plate, positioned adjacent to the air guide duct, and guiding the indoor air from the air guide duct to the air outlet port.

According to one aspect, the air conditioner additionally includes a support rib provided on the partition plate to engage the air discharging duct with the partition plate, wherein the air discharging duct has a support hole engaging the support rib of the partition plate.

According to one aspect, the air discharging has a support block projecting from the air discharging duct, wherein the support hole is provided on the support block.

According to one aspect, the support block has a curved surface to reduce a vortex of the indoor air.

According to one aspect, the support rib of the partition plate has a curved surface to reduce a vortex of the indoor air.

According to one aspect, the support rib and the support hole comprise a plurality of parallel support ribs and a plurality of parallel support holes, respectively.

According to one aspect, the support rib and the support hole comprise a plurality of support ribs and a plurality of support holes, respectively, such that at least one of the plurality of support ribs and at least one of the plurality of corresponding support holes are inclined toward a first sidewall of the cabinet, and at least one of the plurality of support ribs and at least one of the plurality of corresponding support holes are inclined toward a second sidewall of the cabinet, which is opposite to the first sidewall.

BRIEF DESCRIPTION OF THE DRAWINGS

These and/or other aspects and advantages of the invention will become apparent and more readily appreciated from the following description of the preferred embodiments, taken in conjunction with the accompanying drawings of which.

DETAILED DESCRIPTION OF THE PREFERRED EMBODIMENTS

Figure 1:
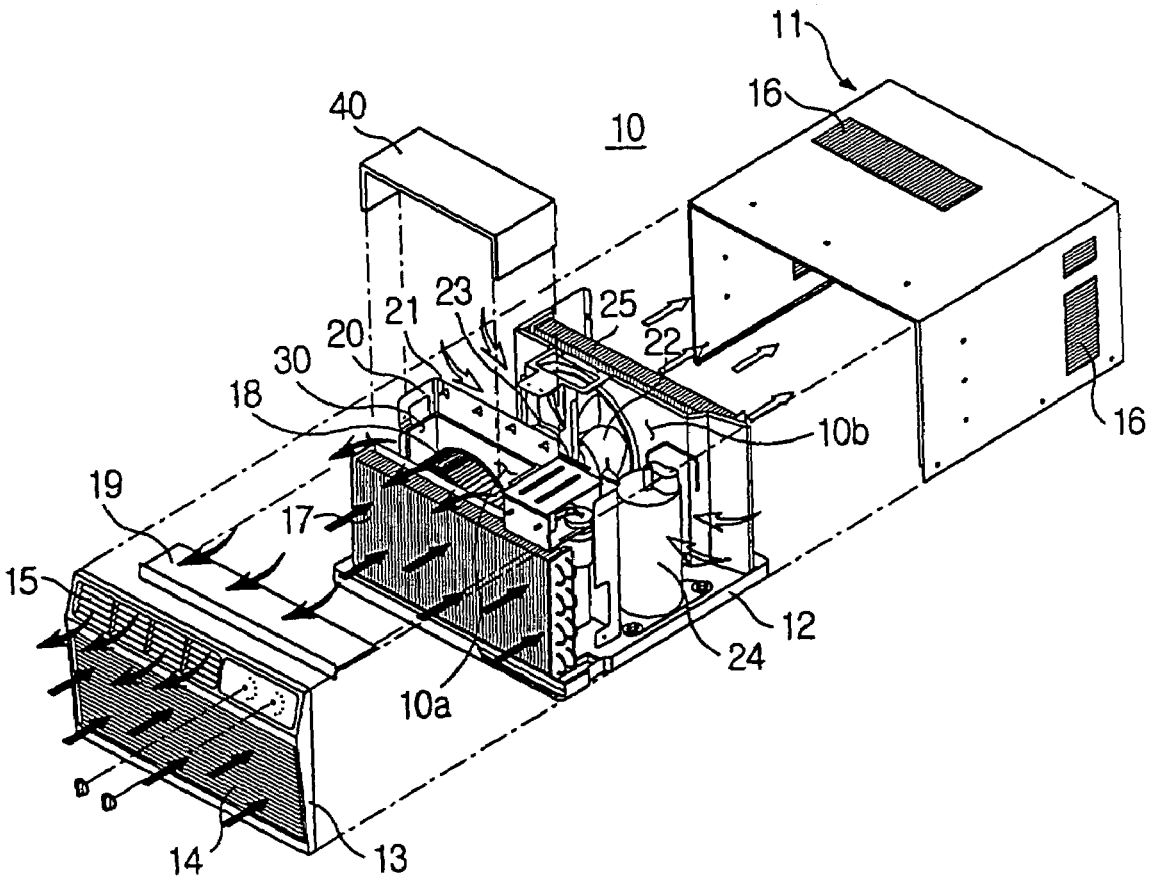
FIG. 1 is an exploded perspective view showing a construction of an air conditioner, according to a first embodiment of the present invention.

Reference will now be made in detail to embodiments of the present invention, examples of which are illustrated in the accompanying drawings, wherein like reference numerals refer to like elements throughout. The embodiments are described below to explain the present invention by referring to the figures.

As is shown in FIG. 1, to fabricate a cabinet 10, a first embodiment of the present invention includes: an upper casing 11 that defines an upper wall and both sidewalls of the cabinet 10, such that the upper wall of the cabinet 10 is integrated with the sidewalls of the cabinet 10; a lower panel 12 that defines a lower wall of the cabinet 10; a front panel 13 that defines a front wall of the cabinet 10; and a rear panel (not shown) which defines a rear wall of the cabinet 10. The cabinet 10 is installed in a window or a wall of room, such that the front panel 13 of the cabinet 10 is placed indoors, and the rear panel (not shown) of the cabinet 10 is placed outdoors.

The front panel 13 has an indoor air inlet port 14 and an indoor air outlet port 15, to draw and discharge indoor air into and from the cabinet 10, respectively. A plurality of outdoor air inlet ports 16 are respectively provided on an outdoor part of the upper wall and the sidewalls of the upper casing 11, which is placed outdoors to draw outdoor air into the cabinet 10. The rear panel (not shown) of the cabinet 10 has an outdoor air outlet port (not shown) to discharge the outdoor air to the atmosphere.

The cabinet 10 defines therein an internal space, which is partitioned into an indoor space part 10*a* to circulate the indoor air, and an outdoor space part 10*b* to circulate the outdoor air. A partition plate 20 is provided in the cabinet 10 to partition the internal space of the cabinet 10 into a front space part and a rear space part, such that the front space part of the cabinet 10 forms the indoor space part 10*a*, and the rear space part of the cabinet 10 forms the outdoor space part 10*b*.

The indoor space part 10*a* of the cabinet 10 seats an evaporator 17 at a position around the indoor air inlet port 14 to generate cool air by executing a heat transfer between the indoor air and a refrigerant. The air conditioner further includes an evaporator fan 18 which is provided in back of the evaporator 17 in the indoor space part 10*a*, to draw the indoor air into the cabinet 10.

In the outdoor space part 10*b* of the cabinet 10, a condenser 25 and a condenser fan 22 are installed to execute a heat transfer between the outdoor air and the refrigerant, and to circulate the outdoor air, respectively. A motor 23 is installed in the outdoor space part 10*b* of the cabinet 10 at a position close to the partition plate 20 to operate the evaporator 17 and the evaporator fan 18. The air conditioner further includes a compressor 24 which is installed in the outdoor space part 10*b* to compress the refrigerant circulating through a refrigeration cycle, thus providing a high-temperature, high-pressure refrigerant.

The air conditioner further includes an air guide duct 30, which is installed in the indoor space part 10*a* at a position close to an indoor side of the partition plate 20, with the evaporator fan 18 being arranged in the air guide duct 30. The air guide duct 30 guides the indoor air discharged from the evaporator fan 18. According to one aspect, the air guide duct 30 guides the indoor air upward. An air discharging duct 40 is placed above both the air guide duct 30 and the evaporator 17 in the indoor space part 10*a*, to guide the indoor air to the indoor air outlet port 15 of the front wall of cabinet 10, after the indoor air is guided upward by the air guide duct 30.

The evaporator 17 is covered with an evaporator cover 19 which is placed above the evaporator 17, so that the indoor air passing through the evaporator 17 is prevented from mixing with the cooled indoor air flowing from the air discharging duct 40 to the indoor air outlet port 15.

The air discharging duct 40 has a plate-type shape to correspond to an inner surface of the upper casing 11. Side ends of the air discharging duct 40 are bent downward and extend, parallel to each other, to a predetermined length, thus forming sidewalls of the air discharging duct 40. The side ends of the air discharging duct 40 are supported by both the air guide duct 30 and the evaporator cover 19, thus defining air-flow channels in the cabinet 10.

Figure 2:
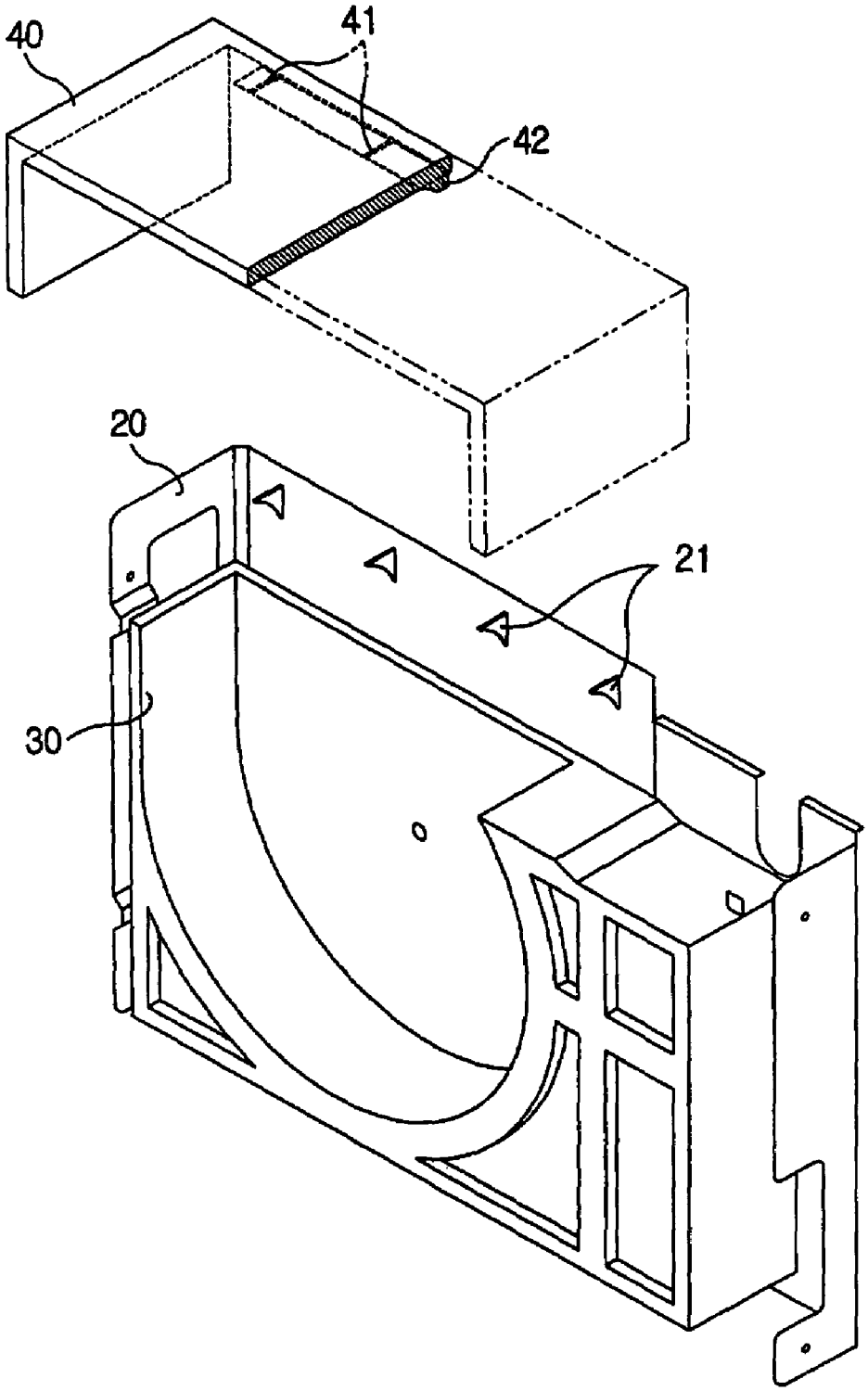
FIG. 2 is a perspective view showing a construction of a partition plate and an air discharging duct of the air conditioner of FIG. 1.
Figure 3:
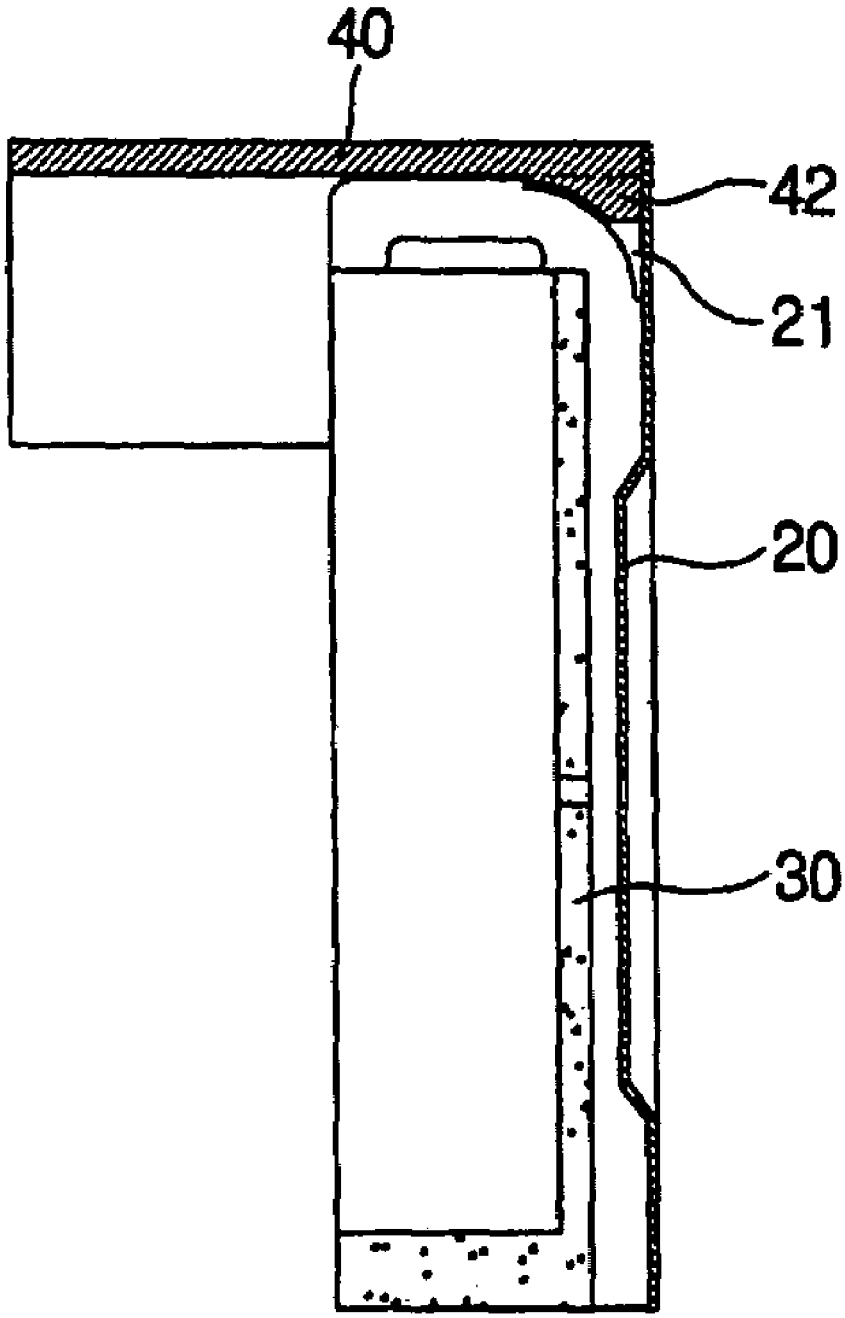
FIG. 3 is a sectional view showing the construction of the partition plate and the air discharging duct of the air conditioner of FIG. 1.

The air discharging duct 40 is made of an insulating material, such as styrofoam, etc., to prevent heat transfer between the upper casing 11 and the cooled indoor air flowing in the air discharging duct 40. As is shown in FIGS. 2 and 3, the air discharging duct 40 is supported on the partition plate 20, so that the discharging duct 40 is stably maintained at a desired position, regardless of a vibration and/or an impact applied thereto.

A plurality of support ribs 21 are respectively provided on the partition plate 20 to support the air discharging duct 40. According to one aspect, the plurality of support ribs 21 project frontward, and are parallel to each other. A plurality of support holes (or recesses) 41 are respectively provided at rear positions of a lower surface of the air discharging duct 40. The plurality of support holes 21 correspond to the plurality of support ribs 20, so that the plurality of support holes 41 engage with the plurality of support ribs 21 of the partition plate 20. The air discharging duct 40 is thus firmly supported on the partition plate 20. According to one aspect, the air discharging duct 40 is coupled to the partition plate 20.

In the first embodiment of the present invention, a support block 42 having a predetermined length is longitudinally arranged on the lower surface of the air discharging duct 40, thus strengthening the air discharging duct 40, regardless of the plurality of support holes 41. In other words, the support block 42 reinforces the air discharging duct 40. According to one aspect, the support block 42 projects downwardly from the air discharging duct. The plurality of support holes 41 are provided on the support block 42 of the air discharging duct 40. Furthermore, the support block 42 and the support ribs 21 each have a curved surface on a front surface thereof. Accordingly, a vortex of the indoor air, which may be generated at a position around a junction of the air discharging duct 40 and the partition plate 20, is reduced because the curved surfaces of the support blocks 42 and the support ribs 21 smoothly guide the indoor air.

Figure 4:
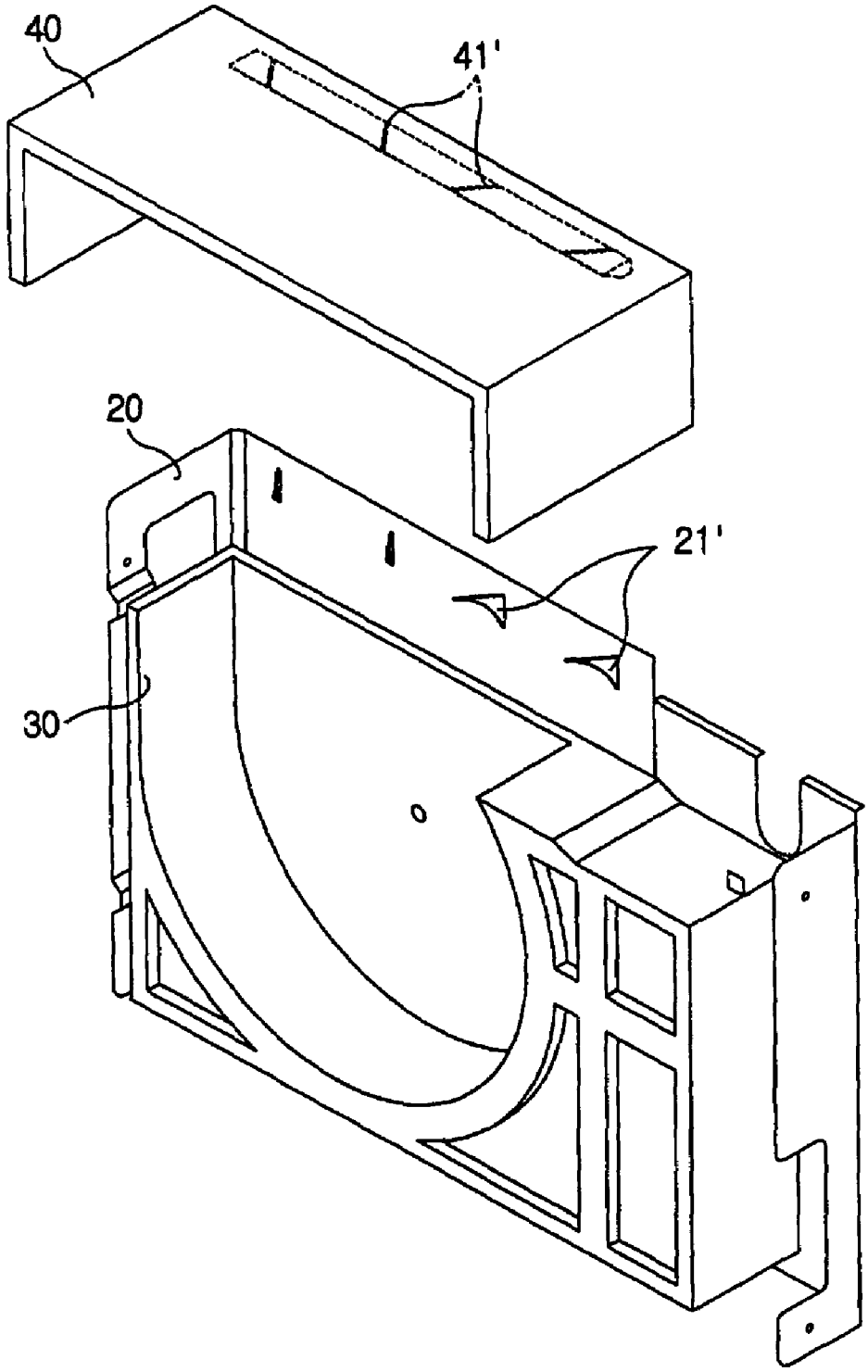
FIG. 4 is a perspective view showing a construction of a partition plate and an air discharging duct of an air conditioner, according to a second embodiment of the present invention.

In the first embodiment of the present invention, the air conditioner has the plurality of parallel support ribs 21 and the plurality of parallel support holes 41, to prevent the air discharging duct 40 from undesirably moving to the left or right. According to a second embodiment of the present invention, some of the plurality of support ribs 21' and corresponding support holes 41, are inclined toward a left sidewall of the cabinet 10, and remaining support ribs 21' and corresponding support holes 41' are inclined toward a right sidewall of the cabinet 10, as is shown in FIG. 4. The support ribs 21' and the support holes 41' according to the second embodiment of the present invention prevent the air discharging duct 40 from undesirably moving to the front, back, left, or right.

Next, the operation, effect, and assembling process of the air conditioner according to the present invention will be described herein below.

First, the partition plate 20, the air guide duct 30, and the evaporator 17 are respectively mounted on the lower panel 12 in the cabinet 10 using a plurality of locking members, such as locking screws. The evaporator cover 19 is placed above the evaporator 17 to cover the evaporator 17. Thereafter, the air discharging duct 40 is placed above both the air guide duct 30 and the evaporator cover 19 such that a lower portion of the air discharging duct 40 is supported on upper portions of the air guide duct 30 and the evaporator cover 19. The air-flow channels are defined in the cabinet 10 by the above-mentioned assembling process, so that the indoor air is guided from the air guide duct 30 to the indoor air outlet port 15 of the front panel 13 of the cabinet 10 through the air-flow channels.

In the above-mentioned assembling process, the support ribs 21 provided on the partition plate 20 respectively engage with the support holes 41 provided on the air discharging duct 40 after the air discharging duct 40 is placed above both the air guide duct 30 and the evaporator cover 19. Therefore, the air discharging duct 40 is firmly supported on the partition plate 20 by the engagement of the support holes 41 with the support ribs 21, so that the air discharging duct 40 is maintained at the desired position in the cabinet 10, regardless of a vibration and/or an impact applied to the air discharging duct 40 during the assembling process.

In addition, when the indoor air passes through the air guide duct 30 and air discharging duct 40 during an operation of the air conditioner, a vortex of the indoor air, which may be generated at the position around the junction of the air discharging duct 40 and the partition plate 20, is reduced, because the support block 42, which is provided on the lower surface of the air discharging duct 40 to reinforce the air discharging duct 40, has a curved front surface thereof.

As is apparent from the above description, the air conditioner of the present invention prevents the air discharging duct 40 from being displaced from a desired position in the cabinet 10, regardless of a vibration and/or an impact applied to the air discharging duct 40, because the air discharging duct 40 is supported on the partition plate 20 by engagement of the plurality of support holes 41 of the air discharging duct 40 with the plurality of support ribs 21 of the partition plate 20. Thus, the assembling process of the air conditioner is simplified.

Furthermore, the air conditioner of the present invention is advantageous in that the air conditioner reduces the vortex of indoor air which may be generated at a position around the junction of the air discharging duct 40 and the partition plate 20, because the air conditioner has the support block 42, which has the curved surface on the front surface thereof and is positioned on a lower surface of the air discharging duct 40 to reinforce the air discharging duct 40.

Although a few embodiments of the present invention have been shown and described, it would be appreciated by those skilled in the art that changes may be made in these embodiments without departing from the principles and spirit of the invention, the scope of which is defined in the claims and their equivalents.

What is claimed is:

1. An air conditioner, comprising:

a cabinet to define an appearance of the air conditioner, a part of the cabinet located indoors, and a remaining part of the cabinet located outdoors;

a partition plate provided in the cabinet to partition an internal space of the cabinet into an indoor space part to circulate indoor air, and an outdoor space part to circulate outdoor air;

an air inlet port and an air outlet port provided on the part of the cabinet that is located indoors, to draw and discharge the indoor air into and from the cabinet, respectively;

an evaporator disposed in the cabinet adjacent to the air inlet port;

a fan to draw the indoor air into the cabinet through the air inlet port such that the indoor air passes through the evaporator to be cooled, prior to being discharged to an outside of the cabinet through the air outlet port;

an air guide duct to guide the indoor air which is drawn into the cabinet, the fan being disposed in the air guide duct;

an air discharging duct, engaging the partition plate, positioned adjacent to the air guide duct and guiding the indoor air from the air guide duct to the air outlet port; and a support rib provided on the partition plate to engage the air discharging duct with the partition plate, wherein the air discharging duct has a support hole engaging the support rib of the partition plate.

2. The air conditioner according to claim 1, wherein the air discharging duct comprises:

a support block projecting from the air discharging duct, wherein the support hole is provided on the support block.

3. The air conditioner according to claim 2, wherein:

the support block has a curved surface to reduce a vortex of the indoor air.

4. The air conditioner according to claim 2, wherein:

the support rib of the partition plate has a curved surface to reduce a vortex of the indoor air.

5. The air conditioner according to claim 1, wherein:
the support rib and the support hole comprise a plurality of parallel support ribs and a plurality of parallel support holes, respectively.

6. The air conditioner according to claim 1, wherein:
the support rib and the support hole comprise a plurality of support ribs and a plurality of support holes, respectively, such that at least one of the plurality of support ribs and at least one of the plurality of corresponding support holes are inclined toward a first sidewall of the cabinet, and at least one of the plurality of support ribs and at least one of the plurality of corresponding support holes are inclined toward a second sidewall of the cabinet which is opposite to the first sidewall.

7. An air conditioner, including inlet and outlet ports, the air conditioner comprising:
an evaporator;
a partition plate;
an air duct guide, guiding air drawn from the inlet port past the evaporator; and
an air discharging duct, engaging the partition plate to prevent movement during assembly, and guiding the air from the air duct guide to the outlet port,
wherein the air discharging duct engages the partition plate without separate fasteners.

8. An air conditioner, including inlet and outlet ports, the air conditioner comprising:
an evaporator;
a partition plate;
an air duct guide, guiding air drawn from the inlet port past the evaporator; and
an air discharging duct, engaging the partition plate to prevent movement during assembly, and guiding the air from the air duct guide to the outlet port,
wherein the air discharging duct has a support hole, and
the partition plate comprises a support rib corresponding to the support hole to engage the air discharging duct.

9. An air conditioner, including inlet and outlet ports, the air conditioner comprising:
an evaporator;
a partition plate;
an air duct guide, guiding air drawn from the inlet port past the evaporator; and
an air discharging duct, engaging the partition plate to prevent movement during assembly, and guiding the air from the air duct guide to the outlet port,
wherein the air discharging duct further comprises a support block to strengthen the air discharging duct.

10. The air conditioner according to claim 8, wherein the air discharging duct further comprises:
a support block to strengthen the air discharging duct,
wherein the support hole is disposed on the support block.

11. The air conditioner according to claim 10, wherein:
the support block and the support rib are curved to reduce a vortex of the air.

12. The air conditioner according to claim 8, wherein:
the support hole is a plurality of support holes; and
the support rib is a plurality of support ribs corresponding to the support holes.

13. The air conditioner according to claim 12, wherein:
the plurality of support ribs are disposed parallel to each other.

14. The air conditioner according to claim 12, wherein:
at least one of the plurality of support holes and at least one of the plurality of support ribs are oriented in a first direction different from a second direction in which at least another one of the plurality of support holes and at least another one of the plurality of support ribs are oriented.

15. The air conditioner according to claim 12, wherein:
at least one of the plurality of support holes and at least one of the plurality of support ribs are oriented in a first direction; and
at least one of the plurality of support holes and at least one of the plurality of support ribs are oriented in a second direction opposite the first direction.

16. An apparatus, comprising:
a cabinet having inlet and outlet ports;
a partition plate partitioning the cabinet and having a support rib;
an evaporator;
an air duct guide guiding air drawn from the inlet port past the evaporator;
an air discharging duct, engaged to the partition plate to prevent movement during assembly and operation, and guiding air from the air duct guide to the outlet port; and
a support rib provided on the partition plate to engage the air discharging duct with the partition plate,
wherein the air discharging duct has a support hole engaging the support rib of the partition plate.

17. A manufacturing method for an air conditioner, comprising:
installing an evaporator for an air conditioner on a lower panel;
installing an air duct guide adjacent to the evaporator, to guide air drawn from an inlet port past the evaporator;
installing a partition plate with a support rib adjacent to the air duct guide, to partition a cabinet of the air conditioner;
installing an air discharging duct adjacent to the air duct guide and the partition plate, to guide the air from the air duct guide to an outlet port, the air discharging duct having a support recess corresponding to and engaging the support rib to secure the air duct guide to the partition plate.

* * * * *